US005409123A

United States Patent [19]

Steiner

[11] Patent Number: 5,409,123

[45] Date of Patent: Apr. 25, 1995

[54] CABLE GUIDE FOR THE TROLLEY TRAVELING WINCH OF GANTRY CRANES

[75] Inventor: Herbert Steiner, Schwabach, Germany

[73] Assignee: Man Gutehoffnungshütte Aktiengesellschaft, Oberhausen, Germany

[21] Appl. No.: 991,740

[22] Filed: Dec. 17, 1992

[30] Foreign Application Priority Data

Dec. 23, 1991 [DE] Germany ..... 41 42 777.7

[51] Int. Cl.[6] ..... B66C 17/00; B63B 27/00

[52] U.S. Cl. ..... 212/205; 212/219; 212/227; 414/141.3; 414/141.4; 414/137.1

[58] Field of Search ..... 212/257, 227, 225, 228, 212/205, 209, 210, 214, 216, 219; 414/137.1, 137.7, 139.9, 140.3, 140.4, 141.3, 141.4, 142.7

[56] References Cited

U.S. PATENT DOCUMENTS

| | | | |
|---|---|---|---|
| 2,366,574 | 1/1945 | Taylor | 212/219 |
| 3,532,227 | 10/1970 | Tax | 212/219 |
| 3,722,705 | 3/1973 | Gould | 212/219 |
| 3,845,865 | 11/1974 | Campbell et al. | 212/227 |
| 3,994,401 | 11/1976 | Tax et al. | 212/228 |

FOREIGN PATENT DOCUMENTS

| | | | |
|---|---|---|---|
| 1088208 | 9/1960 | Germany | 212/219 |
| 1237281 | 3/1967 | Germany | 212/219 |
| 1253159 | 10/1967 | Germany | 414/141.4 |
| 3830429A1 | 3/1990 | Germany . | |
| 1229157 | 2/1969 | United Kingdom . | |
| 1456054 | 9/1974 | United Kingdom . | |

*Primary Examiner*—Michael S. Huppert
*Assistant Examiner*—R. B. Johnson
*Attorney, Agent, or Firm*—McGlew and Tuttle

[57] ABSTRACT

A cable guide for the trolley traveling winch on gantry cranes for container, general-cargo, and grab operation, with a land-side support and a water-side jib that can be tilted up, the necessary deflection rollers, tensioning devices, and at least one cable drum for the trolley traveling winch. In the cable guide for moving the trolley (8), all the cables (3*a*, 3*b*) and (6*a*, 6*b*) are led from the drive drum (13) to the land-side support end and are deflected there in the deflection rollers (7*a*, 7*b*, 7*c*, 7*d*) of the tensioning device (12*a*, 12*b*). One cable pair (3*a*, 3*b*) extends to the land-side cable connection (8*a*, 8*b*) of the trolley, and the second cable pair (6*a*, 6*b*) is led to the water-side jib end (5*a*, 5*b*), and is led to the water-side cable connection (8*c*, 8*d*) of the trolley after deflection by 180°. Since both cable pairs (3, 6) extend at equal cable height (9) from the top edges of the jib (1) and the support (2) of the jib (1), only a simple deflection (14*a*–14*d*) and a low cable tension path are required for deflecting the cable at the fulcrum point (11) of the jib (1) during the retraction or erection.

3 Claims, 2 Drawing Sheets

CABLE GUIDE FOR THE TROLLEY TRAVELING WINCH OF GANTRY CRANES

FIELD OF THE INVENTION

The present invention pertains to a cable guide for a trolley traveling winch on a gantry, crane for container, grab, or general-cargo operations with a land-side support and a water-side jib that can be tilted up, with land-side and water-side traction cable pairs, the necessary deflection rollers, tensioning devices, and at least one cable drum for the trolley traveling winch arranged on the platform of a machine housing.

BACKGROUND OF THE INVENTION

In trolley traveling winches of gantry cranes of the above-mentioned type without direct trolley traveling drive, the trolley is moved by at least one motor-driven cable drum, which is arranged in the machine housing of the gantry crane.

In gantry cranes for container, grab, or general-cargo operations, one cable pair usually extends from the dram in the machine housing to the water-side jib end, and one cable pair extends to the land-side support end. The cables are deflected there and extend to the trolley. The cables extend at different heights, i.e., deflection in the area of the fulcrum point of the jib is highly complicated during the retraction of the jib, especially in order to keep the necessary tensioning path of the cable due to the jointly swinging cable rollers short. Supporting the cables to reduce the sag is possible only in a mechanically highly complicated manner, and it leads to increased wear on the traction cables for the trolley because of the multiple additional deflections of the cable.

Since the cables run off from the drive drum under the machine housing platform, i.e., the drum projects below from the platform, the installation position of the drum and transmission is unfavorable, especially from the viewpoint of maintenance.

SUMMARY AND OBJECTS OF THE INVENTION

It is an object of the present invention to simplify and improve the cable guide such that the cable strands will extend at a short vertical distance above the support as well as the jib, and the deflection of the cable, which is necessary for retracting or erecting the jib, is simpler in the area of the fulcrum point of the jib.

According to the invention, a gantry crane travelling trolley cable guide arrangement is provided for container, grab or general cargo operation wherein the crane includes a land-side support and a water-side jib and wherein the water-side jib can be tilted up. The arrangement includes water-side traction cable pairs cooperating with deflection rollers and tensioning devices, acting on the cable rollers and at least one cable drum for the trolley travelling winch, arranged on the platform of a machine housing. The cable pairs are led from the cable drum arrangement on the platform of the machine housing in a direction of the land-side support end, to deflection rollers. A first length of each cable pair is directly connected to a land-side cable connection at the trolley. A second length of each cable pair is led to the water-side deflection roller at the jib end and is connected to a water-side cable connection of the trolley. The first length of the cable pairs and the second length of the cable pairs extend at equal distance above the support and the jib, respectively, and are guided over support rollers or sliding plates.

When the jib is tilted up and the trolley is operated with the jib in a tilted-up position, the cables are deflected over additional deflection rollers at a fulcrum point of the jib.

In the cable guide according so the present invention, all cables for moving the trolley extend from the drive drum in the machine housing to the land-side support end, and they are deflected there in the deflection rollers of the tensioning device. One cable pair, supported by rollers, extends to the land-side cable connection of the trolley, and the other cable pair, also supported by support rollers or sliding plates, extends to the water-side jib end, and is led to the water-side cable connection of the trolley after deflection.

In this arrangement, in which the cables are supported by support rollers or sliding plates at closely spaced locations over the entire length of the support and jib, the sag of the cables is limited to a minimum. This leads to smooth start-up during the acceleration of the trolley and to improved positioning of the load.

Since all cable strands extend at equal and relatively short vertical distance from the top edge of the jib and support, simple deflection of the cables will be achieved at the fulcrum point of the jib during the retraction of the jib or erection, and the cable tension path will be relatively low.

The cable guide according to the present invention can be used equally in gantry cranes with a single-support system and in gantry cranes with a double-support system.

A further object of the invention is to provide a cable guide for trolley on a land-side support with a water-side jib that can be raised and lowered (tilted) wherein the arrangement of the cables is simplified for ease of maintenance and operation.

The various features of novelty, which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
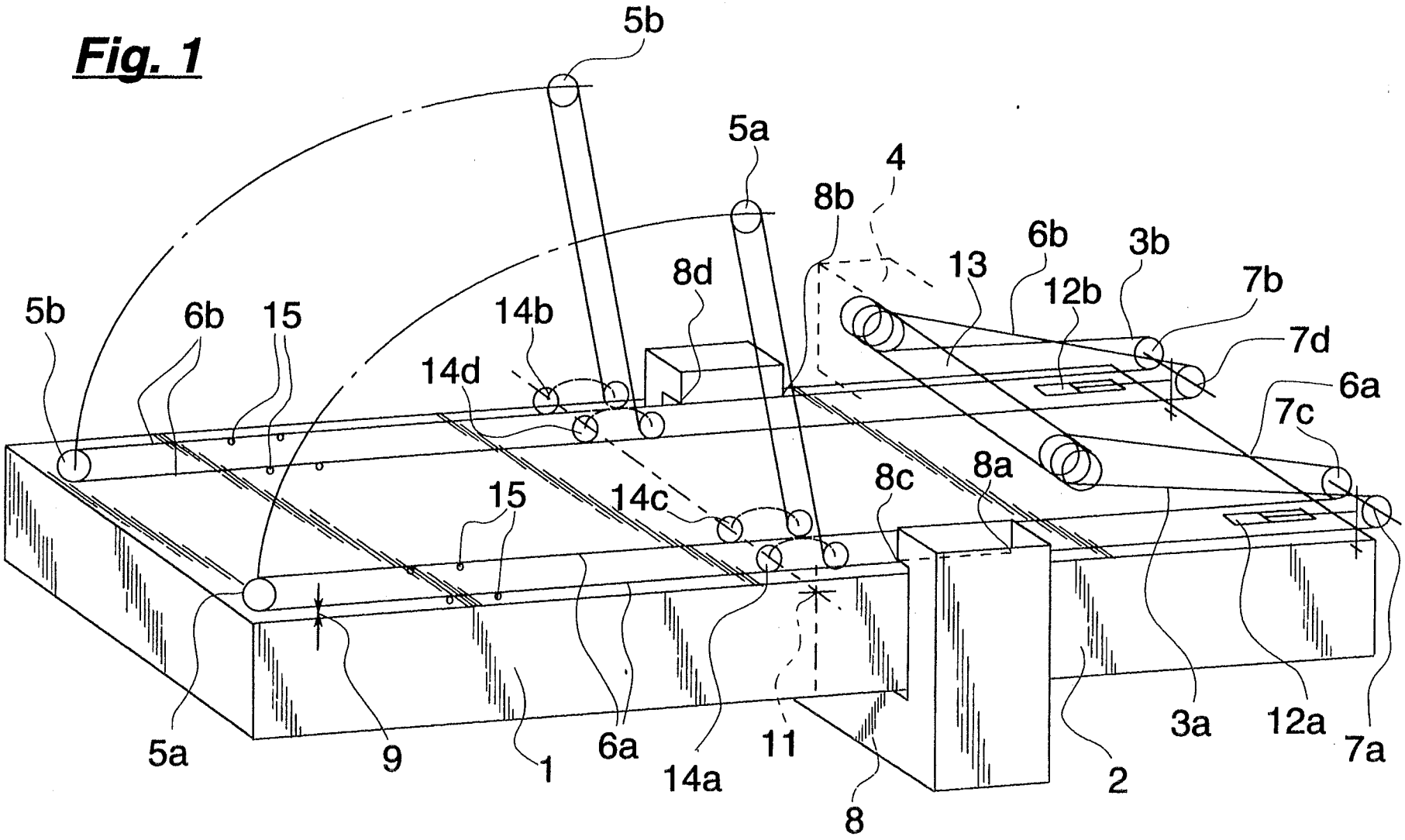
FIG. 1 is a schematic perspective view showing the cable guide arrangement for the gantry crane trolley travelling winch according to the invention.

The invention provides a cable guide for a gantry crane trolley travelling winch for container, general-cargo and grab operation. The crane includes the land-side support 2 and a water-side jib 1 wherein the jib 1 can be tilted up (raised or lowered). The cable guide moves the trolley 8 in a water-side and land-side direction (for unloading containers from sea-going vessels). Rear end cables 3*a*, 3*b* connecting to a land-support end of the trolley 8 and front-end cables 6*a*, 6*b* leading to a water-side support end are led from the drive drum 13 to pairs of land-side support end deflection rollers 7*a*, 7b, 7c, 7d of the tensioning device 12a, 12b. The front end cable pair 3a, 3b is deflected by 180° and extends to a land-side cable connection 8a, 8b of the trolley and the front end cable pair is deflected by 180° and is led to the water-side jib end 5a, 5b and is then led to the water-side cable connection 8c, 8d.

The present invention will be explained in greater detail on the basis of an example of a gantry crane for container operation.

Figure 2:
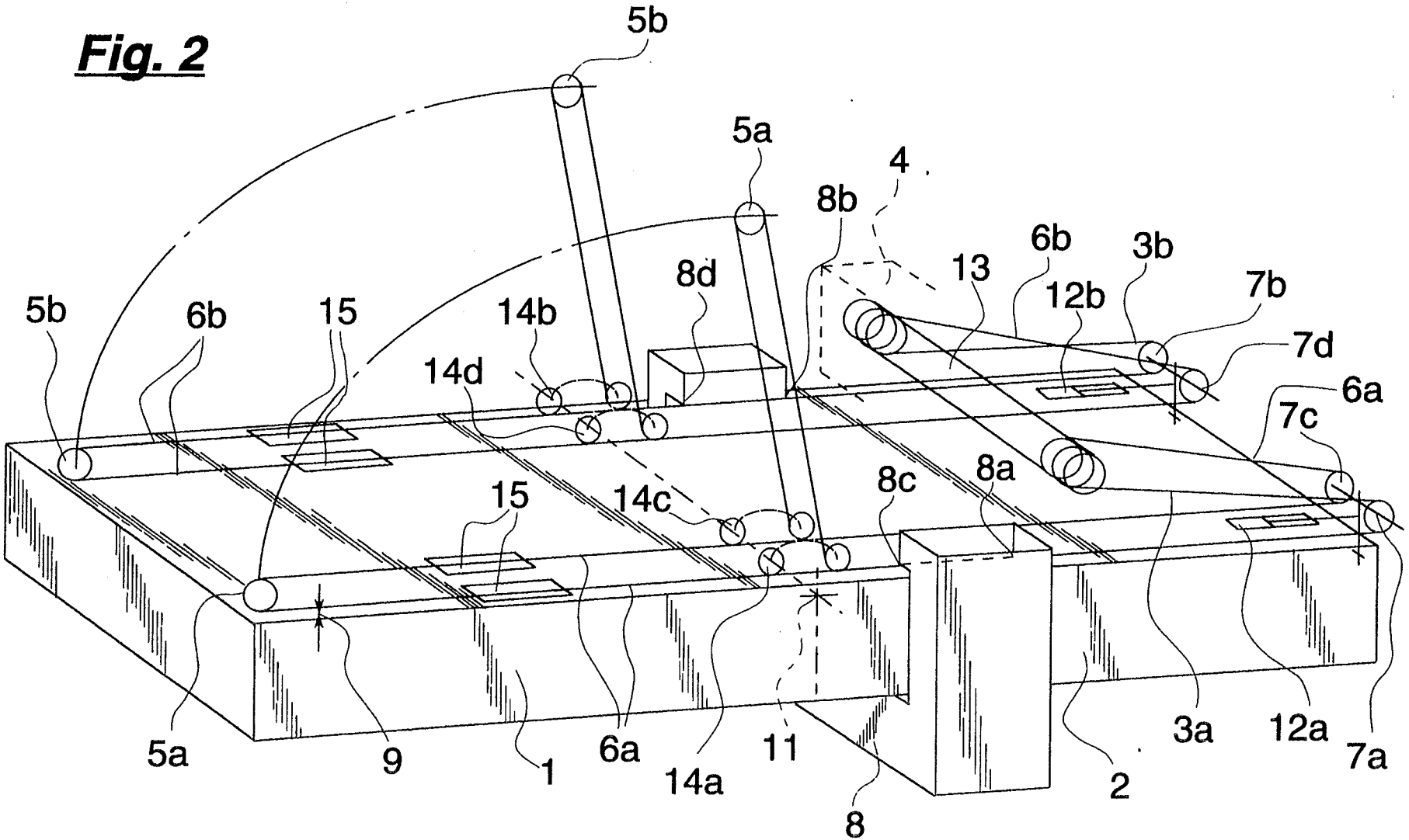
FIG. 2 is a view similar to FIG. 1, showing an alternative cable support structure according to the invention.

Referring to the only Figure in particular, all cable strands 3a, 3b and 6a, 6b are guided directly over the top edge of the support 2 and of the jib 1 in the cable guide according to the present invention for moving the trolley 8 on a container crane with a single-support system. In this improved cable guide, the first or land-side cable pairs 3a, 3b and the second or water-side cable pairs 6a, 6b extend from the drive drum 13 to the deflection rollers 7a, 7c and 7b, 7d at the land-side support end, which are provided with a tensioning device 12a and 12b each for tensioning the cable pairs 3a, 3b and 6a, 6b. The outer land-side cable pair 3a, 3b extends, supported by rollers 15 or sliding plates 16 (see FIG. 2), to the land-side cable connection 8a, 8b of the trolley, and inner water-side cable pair 6a, 6b, also supported by said support rollers 15 or sliding plates 16, extends to the water-side deflection rollers 5a, 5b at the jib end 1, are deflected by 180° there, and led to the water-side cable connection 8c, 8d of the trolley after deflection. The support rollers 15 or sliding plates 16 act as support means guiding and supporting the cables.

Since the cable strands 3a, 3b and 6a, 6b on both sides extend at a relatively short distance 9 from the top edges of the jib 1 and of the support 2, only one set of deflection roller 14a, 14c and 14d, 14b, which defines a path in the form of a circular arc section during the erection or retraction of the jib 1, is necessary at the fulcrum point 11 of the jib 1.

The said cable drum 13 is arranged on the platform 4 of the machine housing of the gantry crane, and is readily accessible for maintenance purposes.

As both cable pairs extend at equal cable height 9 from the top edges or top surface of the jib 1 and the support 2, only a simple deflection 14a, 14d is required and only a low cable tension path is required for deflecting the cable at the fulcrum point 11 of the jib 1 during the lowering or raising of the jib.

While a specific embodiment of the invention has been shown and described in detail to illustrate the application of the principles of the invention, it will be understood that the invention may be embodied otherwise without departing from such principles.

What is claimed is:

1. A gantry crane cable guide arrangement and trolley comprising:

a land-side support having a land-side upper surface;

a water-side jib having a water-side jib upper surface, said water-side jib being connected to said land-side support;

means for pivoting said water-side jib about a horizontal axis;

a gantry crane platform;

a moveable trolley supported by said land-side support or water side jib for moving in a water-side direction and a land-side direction on said land-side support and water side jib;

a cable drum supported on said platform of the gantry crane;

a land-side connection cable pair connected to said cable drum and extending from said cable drum in said land-side direction;

a water-side connection cable pair connected to said cable drum and extending in said land-side direction;

tensioning devices;

deflection rollers at a land side end of said land-side support, said deflection rollers being connected to said tensioning devices, said land-side connection cable pair and said water-side connection cable pair being deflected by said deflection rollers by 180°;

a land-side cable connection at said trolley, said land-side cable connection being connected to ends of said land-side connection cable pair;

water-side deflection rollers connected to a water side end of said water side jib;

a water-side cable connection at said trolley, said water-side connection cable pair being deflected over said water-side deflection rollers and being connected to said water-side cable connection, each of said land-side connection cable pair and said water-side connection cable pair extending an equal distance above said land-side support upper surface and water-side jib upper surface; and support rollers or sliding plates connected to said jib upper surface, each of said land-side connection cable pair and said water-side connection cable pair being guided over said support rollers or sliding plates.

2. A cable guide according to claim 1, further comprising:

a fulcrum point on said jib and, said land-side support; and additional deflection rollers provided at said fulcrum point of said jib and said land-side support, said water-side connection cables being deflected over said additional deflection rollers during operation of said trolley when said jib is in a tilted-up position.

3. A gantry crane cable guide arrangement according to claim 2, further comprising:

additional deflection rollers provided at said fulcrum point of said jib and said land-side support, said water-side connection cables being deflected over said additional deflection rollers during operation of said trolley when said jib is in a pivoted-up position.

* * * * *